US006280165B1

(12) United States Patent
Tsuchiya et al.

(10) Patent No.: US 6,280,165 B1
(45) Date of Patent: Aug. 28, 2001

(54) SCROLL TYPE FLUID MACHINE

(75) Inventors: Takeshi Tsuchiya, Ibaraki-ken; Isao Hayase, Tsuchiura; Kazuo Sakurai, Shizuoka-ken; Mutsunori Matsunaga, Shimizu, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/453,205

(22) Filed: Dec. 3, 1999

(30) Foreign Application Priority Data

Dec. 4, 1998 (JP) ..... 10-345488

(51) Int. Cl.[7] ..... F01C 1/02

(52) U.S. Cl. ..... 418/55.1; 418/57; 418/107; 418/108; 29/888.022

(58) Field of Search ..... 418/55.1, 57, 107, 418/108; 29/888.022

(56) References Cited

U.S. PATENT DOCUMENTS 5,188,520 * 2/1993 Nakamura et al. ..... 418/55.1
5,458,471 * 10/1995 Ni ..... 418/57
5,496,160 * 3/1996 Richardson, Jr. et al. ..... 418/55.1

FOREIGN PATENT DOCUMENTS 59-079086 * 5/1984 (JP) ..... 418/55.1
61-008404 * 1/1986 (JP) ..... 418/55.1
3-294681 * 12/1991 (JP) ..... 418/55.1
5-018202 * 1/1993 (JP) ..... 418/55.1
5-149263 * 6/1993 (JP) ..... 418/55.1
5-149266 * 6/1993 (JP) ..... 418/55.1
6-026471 * 2/1994 (JP) ..... 418/57

* cited by examiner

*Primary Examiner*—Thomas Denion
*Assistant Examiner*—Theresa Trieu
(74) *Attorney, Agent, or Firm*—Antonelli, Terry, Stout & Kraus, LLP

(57) ABSTRACT

A scroll type fluid machine which can practically exhibit an appropriate meshing condition between an orbiting scroll member and an unorbiting scroll member and which can enhance the energy efficiency. A positioning means for positioning the unorbiting scroll member in a frame to which the unorbiting scroll member is to be fixed, comprises an elongated positioning hole formed in the unorbiting stationary scroll, and a positioning pin provided on the frame, and with this arrangement, the positioning is carried out in such a way that the unorbiting scroll is movable, relative to the frame, in a direction of a straight line passing through the center of a stationary scroll lap within a plane orthogonal to the axis of the stationary scroll lap, but is unmovable in a direction crossing the straight line, and the stationary scroll is rotatable around a straight line which passes through a position where the straight line crosses the peripheral edge part of the stationary scroll, and which is in parallel with the above-mentioned axis.

7 Claims, 14 Drawing Sheets

SCROLL TYPE FLUID MACHINE

BACKGROUND OF THE INVENTION

1. Field of the Invention

The present invention relates to a scroll type fluid machine which processes coolant, air or other compressible gas, and in particular to a scroll type fluid machine characterized by the provision of a positioning means for a single unorbiting scroll member which is movable in the direction of a substantially straight line passing through a substantial center of the scroll lap of the unorbiting scroll member but unmovable in a direction substantially orthogonal to the above-mentioned substantially straight line, and which is rotatable, and an unorbiting scroll fixing member, and adapted to appropriately mesh the unorbiting scroll member with an orbiting scroll member so as to aim at ensuring a high degree of energy efficiency.

2. Related Art

Scroll type fluid machines have been widely used as compressors in refrigerators, air-conditioners, and others in various fields. In comparison with other compressors having other configurations, such fluid machines may have preferences such as a high degree of efficiency, a high degree of reliability, stillness and the like, and accordingly, they have been prosperously developed and studied.

Brief explanation will be made of one of the arrangements of these scroll type fluid machines. The basic components of the compression part thereof are a stationary scroll, an orbiting scroll and a frame, the frame being fixed to a closed container, and is also fixed to the stationary scroll with the use of vacant holes in the stationary scroll, fixing thread parts of the frame, and a fixing bolts. The basic components of the stationary scroll are a lap, a mirror plate, a lap bottom, a lap tip and a discharge port, and those of the orbiting scroll are a lap, and a mirror plate, a lap bottom and a lap tip.

The basic components of the drive part of the compressor, for driving the orbiting scroll in order to orbit the latter, are a stator and a rotor in a motor, a crank shaft, an Oldham's ring which is a main component of a mechanism for preventing the orbiting scroll from rotating around its axis, a support member of the crank shaft, for rotatably engaging the frame and the crank shaft with each other, and a support part of the orbiting scroll, for engaging the orbiting scroll and an eccentric pin part of the crankshaft with each other so as to be movable in a thrust direction which is a rotating axis direction and rotatable.

Next, referring to FIG. 10, brief explanation will be made of the compressing operation of the scroll type fluid machine. FIG. 10 shows compression chambers 4*a*1, 4*a*2, 4*b*1, 4*b*2 which are defined by the lap 2*a* of the stationary scroll 2 and the lap 3*a* of the orbiting scroll 3, which are meshed with each other. The compression chambers 4*a*1, 4*a*2, 4*b*1, 4*b*2 shown in this figure are those during compression stroke, and the compressing operation is carried out in such a way that the orbiting scroll carries out orbiting motion so as to reduce the volumes of the compression chambers. During compressing operation, working fluid is sucked into the compression chamber 4 by way of a suction port 5 and a suction space 15 in association with the orbiting motion of the orbiting scroll 3. The sucked working fluid is discharged by way of a discharge space and a discharge port at the time when the compression chamber reaches a position where it is communicated with a discharge port 2*e* of the stationary scroll after the volume of the compression chamber is successively decreased as indicated by 4*a*1, 4*a*2, 4*b*1 and 4*b*2. During the orbiting motion of the stationary scroll 2 and the orbiting scroll 3 which are meshed with each other, there is required sufficient gas-tightness in order to prevent occurrence of leakage of the working fluid between the suction space 15 and the compression chambers 4*a*1, 4*b*1, between the compression chambers 4*a*1, 4*a*2, 4*b*1, 4*b*2, and between the compression chambers 4*a*2, 4*b*2 and the discharge port 2*e*, as far as possible.

Next, brief explanation will be made of an example of a fixing structure between the stationary scroll 2 and the frame 7 with reference to FIG. 11 which is a schematic view illustrating an example of the stationary structure. The purpose of fixing the stationary scroll 2 and the frame 7 with each other is to isolate under pressure a space defined between the frame 7 and the stationary scroll 2 from the discharge space or the suction space in order to carry out appropriate compressing operation. In the example of the fixing structure shown in FIG. 11, the stationary scroll 2 and the frame 7 are fixed together by using a vacant hole 2*f* in the stationary scroll 2, a fixing thread part 7*b* in the frame 7 and a fixing bolt 20. In order to isolate the space from the discharge space and the suction space under pressure, as shown in FIG. 10, a plurality of vacant holes 2*f* in the stationary scroll arranged in a ring-like shape. Further, the diameter of the vacant holes 2*f* is dimensioned so as to allow the fixing bolts 20 to smoothly be inserted there-through in order to facilitate the assembly of the fluid machine.

An example of the positioning means for the stationary scroll, is disclosed in Japanese Laid-open patent No. H5-332267, and is shown in FIG. 12. In this example, a stationary scroll 100 is composed of a first base plate 100*a*, a first spiral member 100*b*, and two reference holes 100*c*, 100*d*, and with the use of the two reference holes 100*c*, 100*d*, the stationary scroll is positioned so that the phases of the spiral bodies of the stationary scroll 100 and the orbiting scroll are precisely shifted from each other by an angle of 180 deg. In FIG. 12, the reference hole 100*d* is elongated. However, it is should not be limited to such an elongated hole. The elongated hole can facilitate the assembly even though there would be errors in pitch accuracy between the reference holes while the clearances between the engaging pin and the reference holes can be minimized, and the phase relationship between both scrolls can be precisely set.

The fixing structure between the stationary structure and the frame, as mentioned above offers problems in view of obtaining an appropriate engaging condition between the orbiting scroll and the stationary scroll in order to ensure a high degree of energy efficiency. As shown in FIG. 10, in consideration with the meshing between the orbiting scroll lap 3*a* and the stationary scroll lap 2*a*, no gaps are theoretically present between the side surfaces of the laps 2*a*, 3*a* at positions where the side surfaces are made into contact with each other, and accordingly, the stationary scroll 2 and the orbiting scroll 3 can be directly meshed with each other. However, since machining tolerances are inevitably present, in fact, in machined components including the stationary scroll 2 and the orbiting scroll 3, small gaps are, in general, defined between the side surfaces of the laps 2*a*, 3*a* so as to prevent interference between the orbiting scroll lap 3*a* and the stationary scroll lap 2*a* during the assembly of the fluid machine and the orbiting motion thereof. Thus, even with scroll type fluid machines with identical specifications, deviation are inevitably caused among the gaps between the side surfaces of the laps 2*a*, 3*a* within the range of machining tolerances.

Further, in the example of the fixing structure between the stationary scroll 2 and the frame 7, shown in FIG. 11, it is frequent that a relatively large gap 21 is defined between the vacant hole 2*f* in the stationary scroll and the fixing bolt 20 as shown in FIG. 11 in order to enable the fixing bolt 20 to be smoothly inserted through the vacant hole 2*f* in the stationary scroll. Accordingly, when the stationary scroll 2 is fixed to the frame 7, there would be caused such a risk that the stationary scroll 2 is fixed, being rotated or parallelly shifted from the neutral position thereof by a degree corresponding to the gap 21.

FIG. 13A shows a meshing condition between the stationary scroll 2 and the orbiting scroll 3 in such a case that the stationary scroll 2 is fixed at the neutral position which is a theoretically meshing position, and FIG. 13B shows a meshing condition between the stationary scroll 2 and the orbiting scroll 3 in such a case that the stationary scroll 2 being fixed after being rotated and shifted from the neutral position. Although a gap of several $\mu$m or several tenth $\mu$m is actually present between the side surfaces of the stationary scroll lap 2*a* and the orbiting scroll lap 3*a,* due to machining tolerances, but it is not visible by its size. Referring FIG. 13A, gaps B1, B2 and C1, C2 defined between the stationary scroll lap 2*a* and the orbiting scroll lap 3*a* in parts where they make contact with each other, are depicted being exaggerated. The X-axis and Y-axis and the center of the stationary scroll lap 2*a* are denoted as XF, YF and OF, respectively, and the X-axis and Y-axis and the center of the orbiting scroll lap 3*a* are denoted as XM, YM and OM, respectively.

FIG. 13A shows a meshing condition in which the orbiting scroll 3 is orbited in the positive Y-axial direction, and the Y axes of the stationary scroll lap 2*a* and the orbiting scroll lap 3*a* are coincident with each other. FIG. 13B shows a meshing condition in which the stationary scroll 2 is rotated counterclockwise about the center OF of the stationary scroll lap from the condition shown in FIG. 13A. When the stationary scroll 2 is rotated and then fixed, the parts B1, B2 and C1, C2 shown in FIG. 13A are changed into parts B3, B4 and C3 and C4. The gaps C3 and C4 are decreased while the gaps B3 and B4 are increased. If the stationary scroll is rotated and moved counterclockwise, and is then fixed, as shown in FIG. 13B, the stationary scroll 2 cannot be rotated at an angle by which the gap between C3 and C4 becomes 0. Contrary, if it is rotated clockwise and then fixed, the stationary scroll 2 cannot be rotated at an angle by which the gap between B3 and B4 becomes 0.

FIGS. 14A to 14D show meshing conditions between the stationary scroll 2 which is fixed after the rotation and the movement shown in FIG. 13B, and the orbiting scroll 3 at angular intervals of 90 deg. in the order of FIGS. 14A to 14D, and explanation will be made of varying situations of gaps D1 to D5 and E1 to E5 which are produced in the meshing between the stationary scroll 2 fixed after rotation and movement, and the orbiting scroll 3. The X- and Y-axes and the center of the stationary scroll lap 2*a* are denoted by XF, YF and OF, respectively, and the X-axis and Y-axis and the center of the orbiting scroll lap 3*a* are denoted by XM, YM and OM, respectively. The gap D1 corresponding to B3 in FIG. 13B is larger than the gap which is fixed at the neutral position, and is maintained to be large always as shown by D1 to D5 during orbiting. Meanwhile, the gap E1 corresponding to C3 in FIG. 13B is smaller than the gap which is fixed at the neutral position, and is maintained to be always small as shown by E1 to E5 during orbiting. In particular, the possibility of such a tendency that the size of the gap produced through D1 to D5 is greater than that of the gap produced at the neutral position is high since it is defined between the laps having different curvatures caused by rotation and movement. In this case, the compression chamber in which D1 to D5 constitute a seal part, has a gap which becomes large always so that leakage during compression is increased, and accordingly, the energy efficiency of the scroll fluid machine is greatly lowered.

Further, in the fixing method as shown in FIG. 11, the stationary scroll is fixed in such a condition that it is rotated and translated within a range of processing tolerance, the size of the gap corresponding to the seal part of the compressing chamber becomes nonuniform, and as a result, the energy efficiency is largely uneven among scroll type fluid machines even having an identical specification.

Further, a stationary scroll fixing means using two reference holes shown in FIG. 12 and disclosed in the Japanese Laid-Open Patent No. H5-332267 offers several problems in view of ensuring an appropriate meshing condition between the orbiting scroll and the stationary scroll, and high energy efficiency. The positioning means using two reference holes can precisely position the stationary scroll at a preset fixing position. That is, it may be construed that the meshing condition between the stationary scroll and the orbiting scroll has been previously determined. However, since dimensional deviations within processing tolerance are inevitably present among the stationary scroll, the orbiting scroll, the Oldham's ring, the frame and the like, and it can be hardly said that the fixing position of the stationary scroll, which has been previously set, always exhibit an appropriate meshing condition between the stationary scroll and the orbiting scroll. Even though the elongated hole as shown in FIG. 12 is used, the fixing position is still determined directly through the combination with the reference hole 100*c,* that is, the appropriate position of the fitting pin is not determined in the range of the elongated hole. Thus, although the positioning means disclosed in this well-known example can position the stationary scroll, surely at the preset fixing position of the stationary scroll, it cannot always be said that this fixing position exhibits an appropriate meshing condition between the orbiting scroll and the stationary scroll.

SUMMARY OF THE INVENTION

An object of the present invention is to provide a scroll type fluid machine which can easily offer an appropriate meshing condition between the scroll lap of an orbiting scroll and the scroll lap of an unorbiting scroll so as to enhance the energy efficiency.

In order to solve the above-mentioned problems, according to the present invention, there is provided a scroll type fluid machine comprising a unorbiting scroll member having a spiral scroll lap and performing limited motion in a plane orthogonal to the axis thereof; an orbiting scroll having a spiral scroll lap meshed with the scroll lap of the unorbiting scroll member so as to define compression chambers and performing orbiting motion without rotation around its axis in the plane orthogonal to the axis, an unorbiting scroll fixing member for limiting the motion of the unorbiting scroll in the plane orthogonal to the axis, and a positioning means for positioning relative positions of the unorbiting scroll member and the unorbiting scroll fixing member in the plane orthogonal to the axis, the positioning means adapted to be used during the assembly of the scroll type fluid machine being constituted in the following manner: that is, the positioning means is composed of parts formed in both unorbiting scroll fixing member and unorbiting scroll member, and is adapted to engage the unorbiting scroll member with the unorbiting scroll fixing member so as to be movable in a direction along a one straight line passing through a substantial center of the unorbiting scroll member in the plane orthogonal to the axis, and to be rotatable about a straight line passing through a position where the one straight line crosses a peripheral edge of the unorbiting scroll member and in parallel with the axis.

The above-mentioned positioning means is composed of an elongated hole structure having a major axis extended in the direction of the one straight line and a pair of wall surfaces which are opposed to each other, and which extend in parallel with the one straight line, and between which the one straight line extends and a pin structure having a pin part rotatably fitted in the elongated hole so as to be movable along the pair of wall surfaces, either one of the elongated hole structure and the pin structure may be formed in the peripheral edge part of the unorbiting scroll, and the other one of them may be formed in the unorbiting scroll fixing member.

During actual positioning, the pin part of the pin structure is fitted in the elongated hole structure, then the unorbiting scroll is shifted along the major axis of the elongated hole as far as possible in the direction in which the center of the scroll lap of the unorbiting scroll member comes away from the center of the scroll lap of the orbiting scroll member in a condition in which the scroll lap of unorbiting scroll member is meshed with scroll lap of the orbiting scroll member so as to be turnable, then, after the orbiting scroll member is turned by an angle of about 180 deg. from the position, the unorbiting scroll member is similarly shifted along the major axis of the elongated hole as far as possible in the direction in which the center of the scroll lap of the unorbiting scroll member comes away from the center of the scroll lap of the orbiting scroll member, and the unorbiting scroll member may be positioned at the middle position of the above-mentioned shift.

Further, at the position set by the above-mentioned shift, the unorbiting scroll member is rotated about the pin structure as a center in a range in which the orbiting motion of the orbiting scroll can be made, and the unorbiting scroll member is desirably positioned at a middle position of the rotating angle.

With the above-mentioned positioning means according to the present invention, the gaps between the side surfaces of both scroll laps can be adjusted within an assembly error caused by the accumulation of processing tolerances of components such as the orbiting scroll member, the unorbiting scroll member, the member for fixing the unorbiting scroll member and the drive means for driving, the orbiting scroll member.

Detailed explanation will be hereinbelow made of preferred embodiments of the present invention with reference to the accompanying drawings, which are in specifically limited forms of the present invention, with reference to the accompanying drawings among which:

DETAILED DESCRIPTION OF THE PREFERRED EMBODIMENTS

Figure 1A:
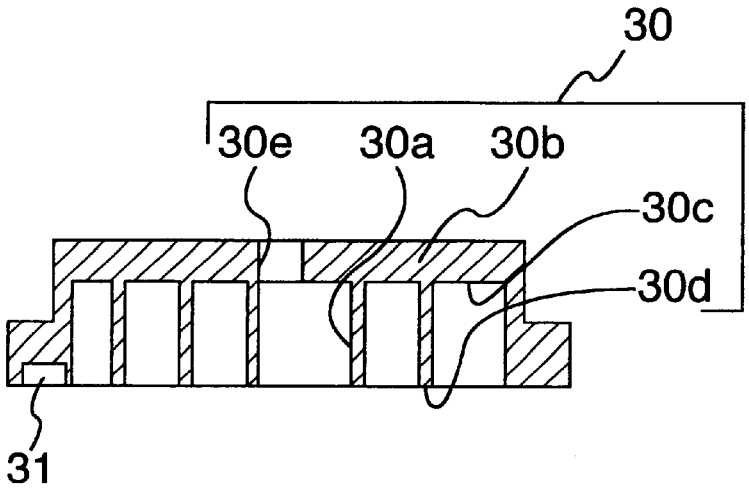
FIG.1A PRIOR ART
FIG. 1A is sectional view illustrating an arrangement of a stationary scroll in a first embodiment of the present invention.
Figure 1B:
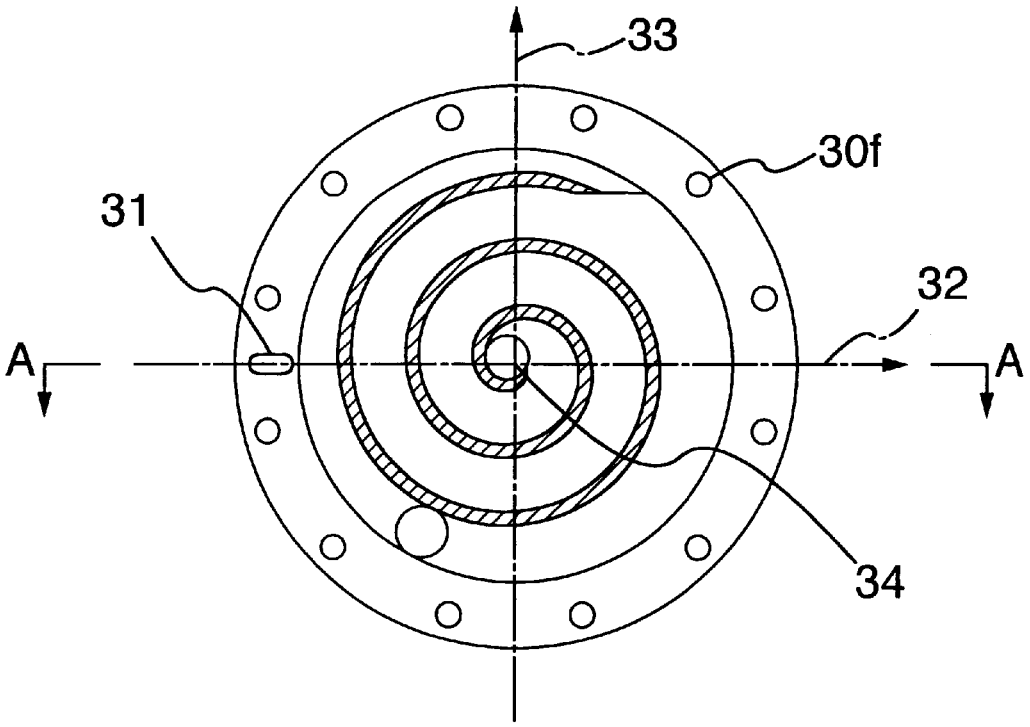
FIG.1B PRIOR ART
FIG. 1B is a plan view illustrating the stationary scroll shown in FIG. 1A.

Detailed explanation will be made of a first embodiment of the present invention with reference to FIGS. 1A to 5D. First, the arrangement thereof will be explained with reference to FIGS. 1A to 2B. FIGS. 1A and 1B show the arrangement of a stationary scroll 30. FIG. 1B is a plan view illustrating the stationary scroll 30 as viewed from the lap side, and FIG. 1A is a sectional view along line A—A in FIG. 1B as viewed in the direction of the arrows. The basic structural parts of the stationary scroll 30 are a lap 30*a,* a mirror plate 30*b,* a lap bottom 30*c,* a lap tip 30*d,* a discharge port 30*e,* fixing vacant holes 30*f* and elongated positioning holes 31.

It is noted that the XY coordinates as shown are composed of an original point which is the center 34 of the lap 30*a,* an X-axis 32 and a Y-axis 33. In this arrangement, the parallel parts of the elongated positioning hole 31 in the stationary scroll are parallel with the X-axis 32, but the elongated positioning hole 31 may be arranged at any position if its parallel parts in the major axis direction are substantially parallel with a straight line substantially passing through the center 34 of the lap 30*a*. However, it is preferable to extend the straight line passing through the above-mentioned center, between the parts of the elongated positioning hole 31 in the major axis direction, which are parallel with the major axis of the elongated positioning hole 31. FIGS. 1A and 1B show an example in which the position and the direction of the elongated positioning hole 31 are selected so as to cause the X-axis 32 passes between the parallel parts of the elongated positioning hole 31. In other words, the straight line passing substantially through the center 34 of the lap 30*a* is one of those including a straight line passing through a position separated from the center 34 of the lap 30*a* by a distance which is about one-half of the minor axis of the elongated positioning hole 31.

It is noted, in the explanation hereinbelow, that the axis of the stationary scroll 30 corresponds to the one in the upright direction of the lap 30*a* at the center of the lap 30*a,* that is, the normal to the mirror plate 30*b*. The elongated positioning hole 31 is opened to a surface opposed to the frame 40 in the peripheral edge part of the stationary scroll 30 in which the fixing vacant holes 30*f* are provided, that is, in a plane perpendicular to the above-mentioned axis, and has a pair of wall surfaces which are in parallel with the above-mentioned straight line passing substantially through the center, and which are opposed to each other on both sides of the straight line.

Figure 2A:
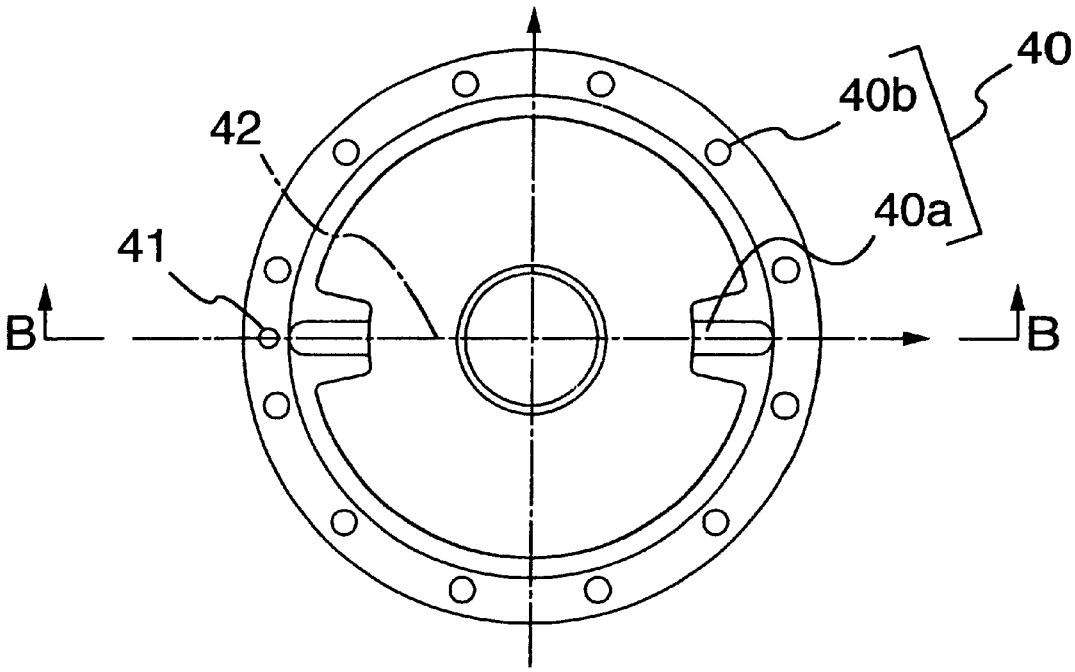
FIG. 2A is a plan view illustrating the arrangement of a frame in the first embodiment of the present invention.
Figure 2B:
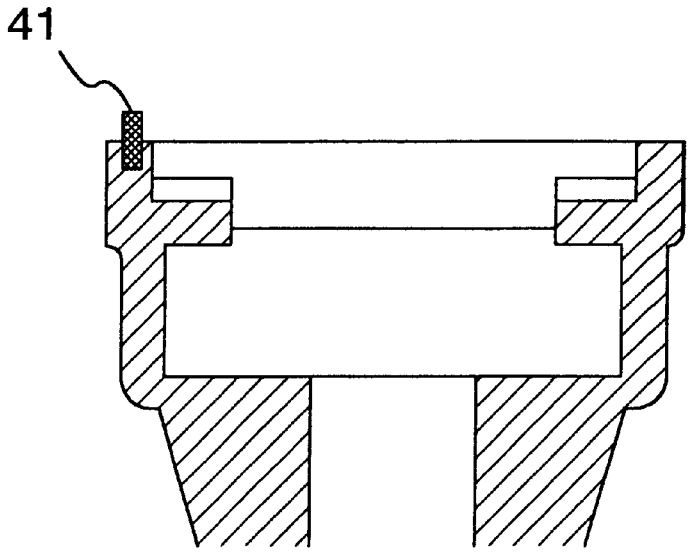
FIG. 2B is a sectional view illustrating the frame shown in FIG. 2A.

FIGS. 2A and 2B show the arrangement of the frame 40 which is an unorbiting scroll fixing member for fixing the stationary scroll 30. FIG. 2A is a plane view illustrating the frame 40 as viewed from the stationary scroll side, and FIG. 2B is a sectional line along line B—B in FIG. 2B as viewed in the direction of arrow.

The frame 40 is provided with key grooves 40*a* in each of which one of two orthogonal key parts formed on an Oldham's ring as a main part in a rotation preventing mechanism slides, and fixing thread parts 40*b* formed at positions corresponding to the vacant holes 30*f* in the stationary scroll, and a positioning pin 41. The frame 40 is located so as to have a predetermined positional relationship with the orbiting scroll, and regulates and inhibits the motion of the stationary scroll in a plane perpendicular to the above-mentioned axis, relative to the frame 40.

The position where the stationary scroll is located, that is, the position where the stationary scroll lap 30*a* and the orbiting scroll lap are theoretically meshed with each other will be herein below referred to "the neutral position" for the sake of brevity in explanation. Further, the position at which the frame is located and which is determined by the positional relationship among the orbiting scroll, the Oldham's ring and the key grooves 40*a* formed in the frame when the stationary scroll 30 is located at the neutral position will be referred to "the neutral position of the frame".

It is noted that the position where the positioning pin 41 serving as the pin part of the pin structure as one of the positioning means is arranged in the frame 40 is set on the straight line which passes substantially though the center of the stationary scroll lap 30*a* and which is used for forming the parallel parts of the elongated positioning hole 31 in the stationary scroll 30 in such a case that the frame is located at the neutral position, and in the configuration of the present embodiment, it is set on a straight line 42 on the frame, corresponding to the X-axis 32 of the stationary scroll 30. In other words, the position where the positioning pin 41 is located on the frame 40, is a position at which the straight line 42 crosses the surface of the frame 40 which is opposed to the surface formed therein with the above-mentioned vacant holes 30*f* in the peripheral edge part of the stationary scroll. As shown in FIGS. 2A and 2B, although the positioning pin 41 is formed independent from the frame 40, they may be integrally incorporated with each other. Further, if the stationary scroll 30 and the frame 40 are arranged at the neutral positions, the positioning pin 41 is previously set on the frame 40, and thereafter, the elongated positioning hole 31 having parts which are parallel with a straight line passing substantially through the position of the stationary scroll corresponding to the center of the pin of the positioning pin 41 and the center of the stationary scroll may be formed in the stationary scroll 30.

Figure 3:
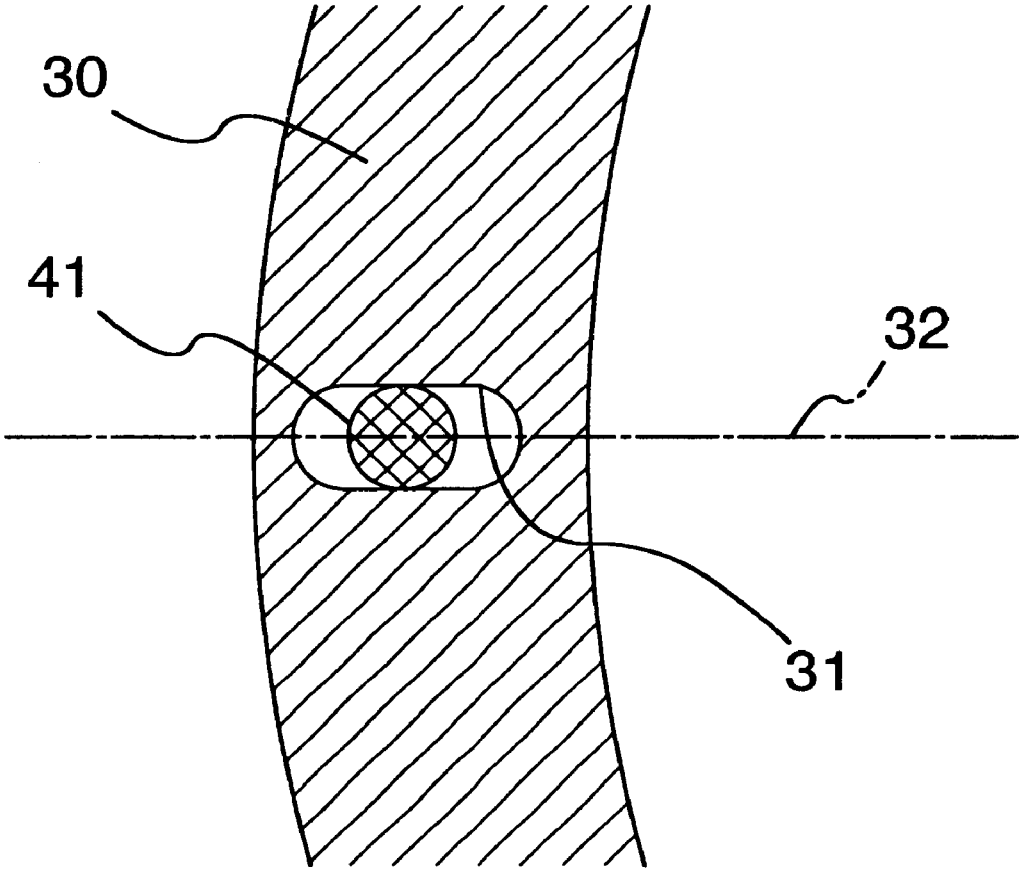
FIG. 3 is a plan view for explaining the functions of an elongated positioning hole and a positioning pin in the first embodiment.

FIG. 3 is a schematic view which shows an arrangement in which the elongated positioning hole 31 in the stationary scroll lap 30 shown in FIGS. 1 and 2, is combined with the positioning pin 41 on the frame 40, and further detailed explanation will be made of the positioning means composed of the elongated positioning hole 31 and the positioning pin 41. The straight line passing substantially through the center of the stationary scroll lap 30*a* corresponds to the X-axis 32 of the stationary scroll lap 30*a* in the configuration of the present embodiment. The elongated positioning hole 31 and the positioning pin 41 have such a function that the stationary scroll 30 can be translated along the parallel parts of the elongated positioning hole 31, but cannot be moved in a direction orthogonal to the parallel parts since it is restrained by the parallel parts, and the stationary scroll 30 can be rotated around the positioning pin as a rotating center. It is noted that the radial position of the positioning pin is determined so as that the arrangement in which the positioning pin 41 is located at a substantially middle position of the elongated positioning hole 31 as shown in FIG. 3 exhibits the neutral position of the stationary scroll 30.

Figure 4A:
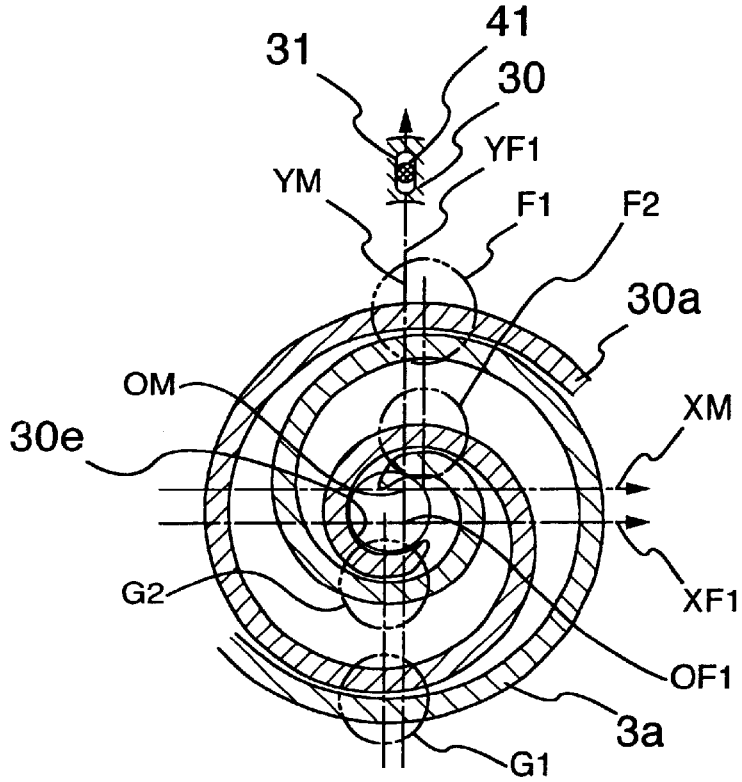
FIGS. 4A and 4B are plan views showing gaps between side surfaces of both stationary and orbiting laps, due to by translation of the stationary scroll.
Figure 4B:
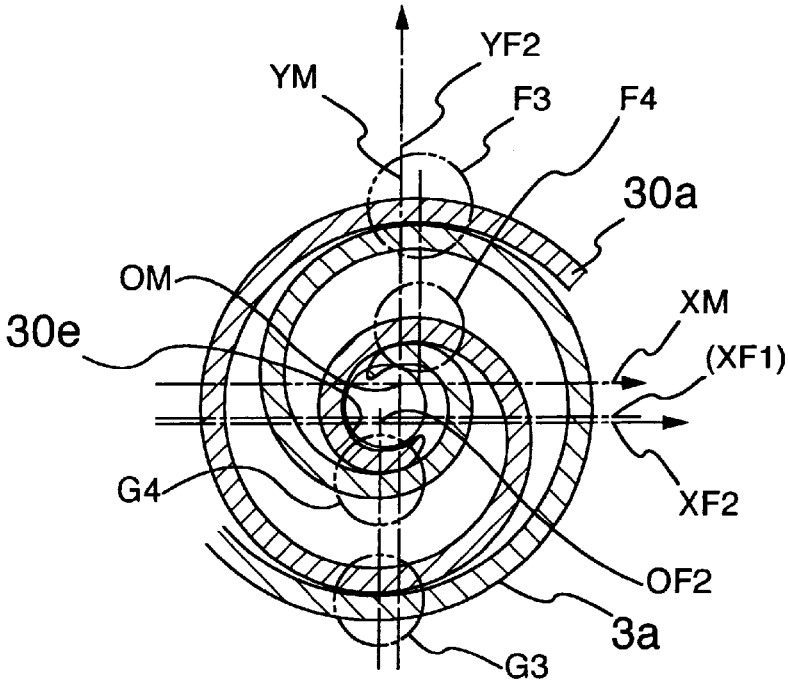

Next, referring to FIGS. 4A to 5D, detailed explanation will be made of the effects exhibited by the positioning with the use of the elongated positioning hole 31 and the positioning pin 41. FIG. 4A shows a meshing condition between the stationary scroll 30 and the orbiting scroll 3 in such a case that the stationary scroll is fixed at the neutral position which is the theoretical meshing position, and FIG. 4B shows a meshing condition between the stationary scroll 30 and the orbiting scroll 3 in such a case the stationary scroll 30 is fixed after it is translated from the neutral position. The X-axis, Y-axis and the center of the stationary scroll 30*a* are denoted by XF1, YF1 and OF1, respectively, if the stationary scroll lap 30*a* is located at the neutral position, but are denoted by XF2, YM2, OF2, respectively, after the stationary scroll lap 30*a* is translated, and the X-axis, Y-axis and the center of the orbiting scroll lap 3*a* are denoted by XM, YM and OM, respectively. Further, FIGS. 4A and 4B show such a condition that the orbiting scroll 3 is turned in the positive direction of the Y-axis, and is then meshed, and accordingly, the Y-axes YF1, YF2 of the stationary scroll lap 30*a* are coincident with the YM of the orbiting scroll lap 3*a*.

Figure 13A:
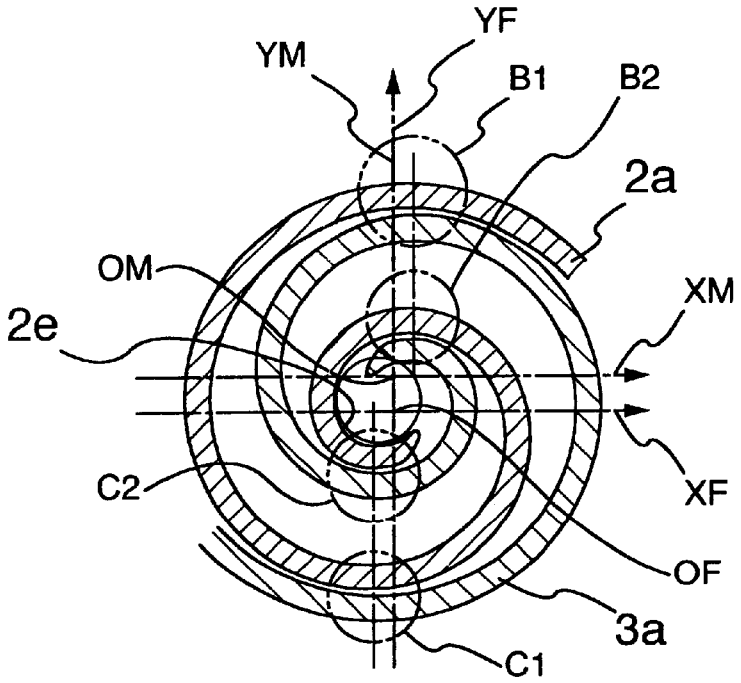
FIGS. 13A and 13B are explanatory views for variation of gaps between side surfaces of stationary and orbiting scroll laps due to rotation and shift of the stationary scroll in a conventional scroll-type fluid machine.
Figure 13B:
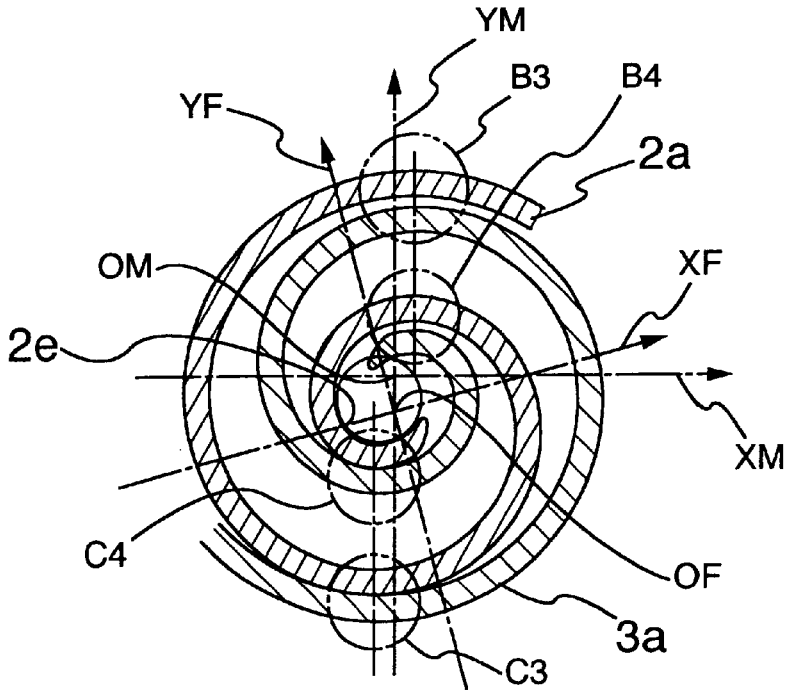
Figure 14A:
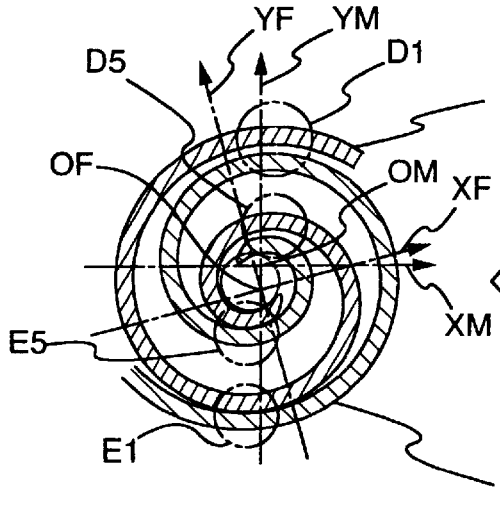
FIGS. 14A to 14D are explanatory views for variation of gaps between side surfaces of stationary and orbiting scroll laps due to rotation and shift of the stationary scroll in conventional scroll type fluid machine.
Figure 14D:
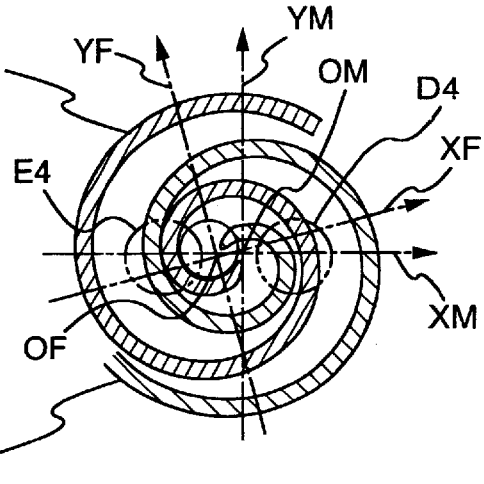
Figure 14B:
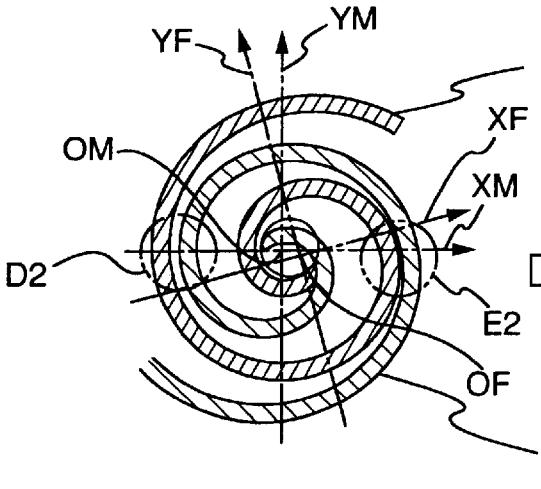
Figure 14C:
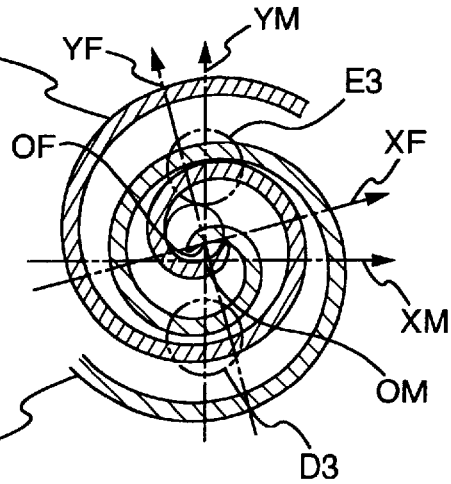

In practice, although gaps in a range from several $\mu$m to several tenth $\mu$m are defined between side surfaces of the stationary scroll lap 30*a* and the orbiting scroll lap 3*a* due to processing errors of the components including the stationary scroll lap 30*a* and the orbiting scroll lap 3*a,* they have not visible sizes. In order to clearly show the situation of variation of the gap as the stationary scroll is translated and is then fixed as shown in FIGS. 4A and 4B, the gaps F1, F2, and G1, G2 in the parts where the stationary scroll lap 30*a* and the orbiting scroll lap 30*b* theoretically make contact with each other are exaggerated in FIG. 4*a* in order to allow the gaps to be visible. FIG. 4B shows a condition such that the stationary scroll 30 is translated in the negative direction of the Y-axis YF1 from the condition shown in FIG. 4A, and is fixed. As explained in FIGS. 1A to 3, the elongated positioning hole 31 formed in the stationary scroll 30 and the positioning pin 41 provided on the frame 40 are arranged on the Y-axes YF1, YF2 and YM of the stationary scroll 30 and the orbiting scroll 3, as shown in FIGS. 4A and 4B, thereby the translation of the stationary scroll 30 and the rotation thereof around the positioning pin 41 as a center can be made. If the stationary scroll 30 is translated in the negative direction of the Y-axis and is fixed, the parts F1, F2 and G1, G2 shown in 4A are changed into parts F3, F4 and G3, G4. The gaps in the parts F3, F4 and G3, G4 are decreased, different from the rotation and movement as shown in FIGS. 13A and 13B.

FIGS. 5A to 5D show meshing conditions between the stationary scroll 30 and the orbiting scroll 3 after the translation, as shown in FIG. 4B, at intervals of 90 deg, successively, in the order of FIGS. 5A to 5D, and explanation will be made of a situation of variation of gaps H1 to H5, J1 to J5 which are produced by meshing between the stationary scroll 30 fixed after the translation, and the orbiting scroll. The X-axis, the Y-axis and the center of the orbiting scroll 3 are denoted by XM, YM and OM, respectively, and estimation is made such that the elongated positioning hole 31 formed in the stationary scroll 30 and the positioning pin 41 located in the frame 40 are arranged in the positive direction of the Y-axis YF2 of the stationary scroll 30, similar to that shown in FIGS. 4A to 4B, although it is not shown in FIGS. 5A to 5D. The gap H1 corresponds to F3 in FIG. 4B, and is smaller than that in such a case that the scroll 30 is fixed at the neutral position, and during the orbiting motion, large and small gaps are repeatedly defined as denoted by H1 to H5. Similarly, the gap J1 corresponds to G3 in FIG. 4B, and is smaller than that in such a case that the scroll 30 is fixed at the neutral position, and during orbiting motion, small gaps and large gaps are repeatedly defined as denoted by J1 to J5.

Large difference is only found such that either a condition in which the gap is always small or a condition in which the gap is always large is present in a case of the fixing after the rotation and movement, but large and small gaps are repeatedly defined in a case of the fixing only after the translation. In the case of only the translation, small gap conditions inevitably occur in the compression chambers having seal parts exhibited by H1 to H5 and J1 to J5, and accordingly, leakage during compression, which would be caused by a large gap always defined in such a case that the fixing is made after rotation and movement, does not occur, thereby it is possible to eliminate occurrence of such a risk that the energy efficiency of the scroll type fluid machine is greatly decreased.

Figure 5A:
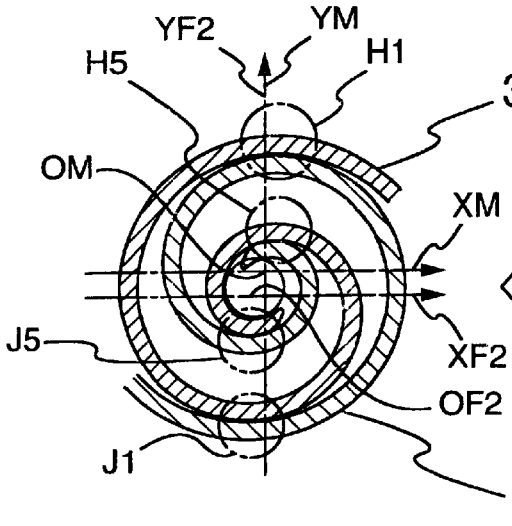
FIGS. 5A to 5D are plan views showing gaps between the side surfaces of both laps, which vary through the translation of the stationary scroll.
Figure 5D:
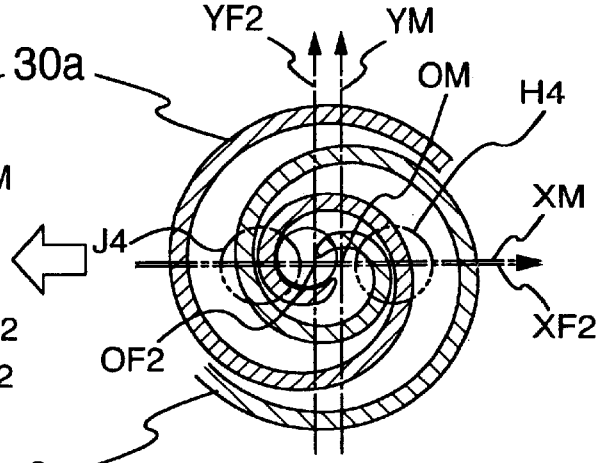
Figure 5B:
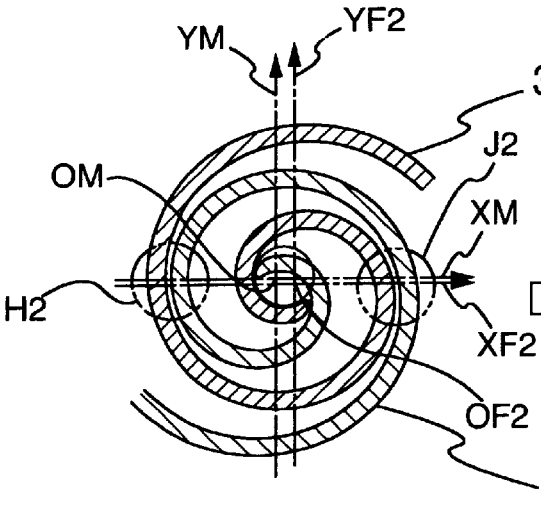
Figure 5C:
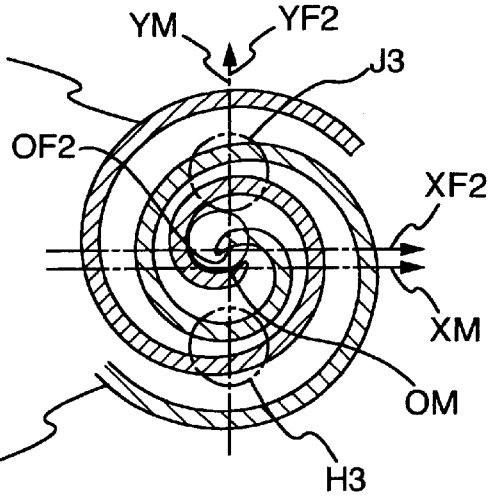

Further, referring to FIG. 5*a* which shows a condition in which the stationary scroll 30 is translated as far as possible in a direction from the center OM of the orbiting scroll lap 3*a* to the center OF2 of the stationary scroll lap 30*a* in such a condition that the orbiting scroll 3 can be orbited, the gaps H3, J3 as shown in FIG. 5*c,* that is, in such a meshing condition that the orbiting motion is performed by an angle of substantially 180 deg. from the orbiting position shown in FIG. 5*a,* may correspond to a negative component of the Y-axis YF2 of the stationary scroll 30 due to assembly errors caused by accumulation of processing errors of components including the stationary scroll lap 30*a* and the orbiting scroll lap 3*a.* On the contrary, in a meshing condition shown in FIG. 5C, after the stationary scroll 30 is translated as far as possible from the center OM of the orbiting scroll lap 3*a* in a direction toward the center OF2 of the stationary scroll 30*a* in a condition in which the orbiting scroll can orbit, the gaps H1, H5 and J1 and J5 are similarly defined in a meshing condition as shown in FIG. 5A, in which turning by an angle of about 180 deg. is carried out. These gaps may correspond to the positive component of the Y-axis YF2 of the stationary scroll caused by assembly errors exhibited by accumulation of processing errors of components including the stationary scroll lap 30*a* and the orbiting scroll lap 3*a.* Accordingly, if the stationary scroll is fixed at the center (middle point) of the range of the translation of the stationary scroll, the stationary scroll 30 can be set at a substantially neutral position with respect to the direction of the Y-axis YF2, and accordingly, an appropriate meshing condition can be obtained between the stationary scroll lap 30*a* and the orbiting scroll lap 3*a,* thereby it is possible to enhance the energy efficiency.

Further, as mentioned above, since the elongated positioning hole 31 provided in the stationary scroll 30 and the positioning pin 41 provided to the frame are arranged in the positive direction of the Y-axis YF2, similar to FIGS. 4A and 4B, although it is not shown in FIG. 5, the stationary scroll 30 can be rotated around the positioning pin 41 as a center. It is noted that, in the meshing condition shown in FIG. 5B, the stationary scroll can be shifted in the direction of the X-axis XF2 by a distance which is substantially equal to the sum of the gaps H2, J2, and further, in the meshing condition shown in FIG. 5D, the stationary scroll 30 can be shifted in the direction of the X-axis XF2 of the stationary scroll XF2 by a distance which is substantially equal to the sum of the gaps H4, J4. At this time, the sum of the gaps H2, J2 or the sum of the gaps H4, J4, which is equal to the distance by which the stationary scroll 30 can be shifted in the direction of the X-axis XF2, may be substantially equal to the component of the stationary scroll 30 in the direction of the X-axis XF2, which is exhibited by assembly errors caused by accumulation of processing errors of components including the stationary scroll laps 30*a* and the orbiting scroll laps 3*a.* Further, since the parallel distances from the positioning pin 41 to the parts H2, J2 or to the parts H4, J4, are greater substantially than the sum of the gaps H2, J2 or the sum of the gaps H4, J4, the shift of the stationary scroll 30 caused by the rotation of the positioning pin 41 exhibits such an effect that the stationary scroll 30 is substantially translated in the direction of the X-axis XF2. Accordingly, in the meshing condition shown in FIG. 5B or FIG. 5D, if the stationary scroll 30 is fixed at a position which is obtained substantially by one half of the shift distance of the stationary scroll from the condition in which the stationary scroll 30 is rotated and shifted as far as possible from the center OM of the orbiting scroll lap 3*a* to the center OF2 of the stationary scroll 30 in a condition in which the orbiting scroll 3 can orbit, to the condition in which it is shifted in the reverse direction as far as possible, the stationary scroll 30 can be set at a substantially neutral position even in the direction of the X-axis XF2, and accordingly, it is possible to ensure high energy efficiency.

Even though the process of forcibly positioning the stationary scroll 30 at a substantially neutral position, as mentioned above, is not carried out, if the stationary scroll 30 is fixed in such a condition that the orbiting scroll 3 can orbit, the gaps between the laps can be adjusted within assembly errors caused by accumulation of processing errors of the components including the stationary scroll lap 30*a* and the orbiting scroll lap 3*a* by means of the elongated positioning hole 31 provided in the stationary scroll 30 and the positioning pin 41 provided in the frame. That is, the main feature of the present invention is such that the rotation and the shift relating to the center of the stationary scroll lap is restrained as far as possible while the stationary scroll is translated in the combination of the elongated positioning hole and the positioning pin so as to allow the gaps between the laps to be automatically adjusted within assembly errors caused by accumulation of processing errors of components. Further, another main feature of the present invention is such that the position where the stationary scroll 30 which is positioned according to the present invention is fixed, is neither a designed substantially neutral position nor the one where the gaps between the laps are adjusted within assembly errors on design, but either a substantially neutral position which can be actually determined by the components, or the one where the gaps between the laps are adjusted within assembly errors which are actually determined from the components.

Figure 6A:
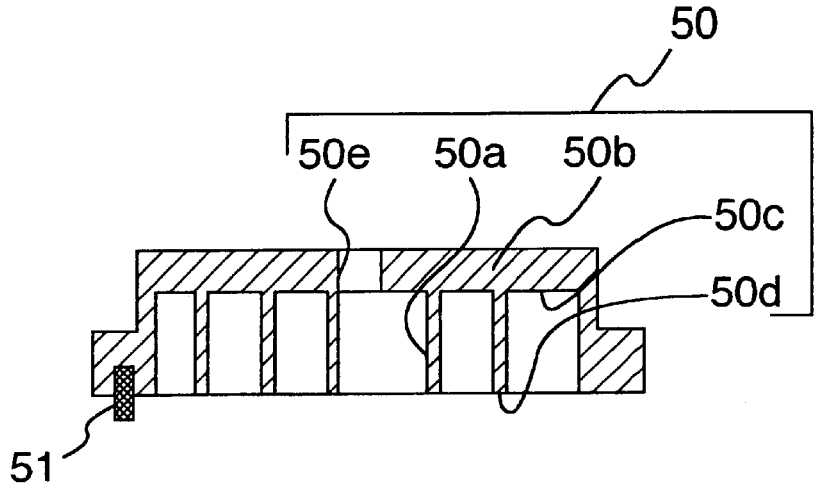
FIG. 6A is a sectional view illustrating the arrangement of a stationary scroll in a second embodiment of the present invention.
Figure 6B:
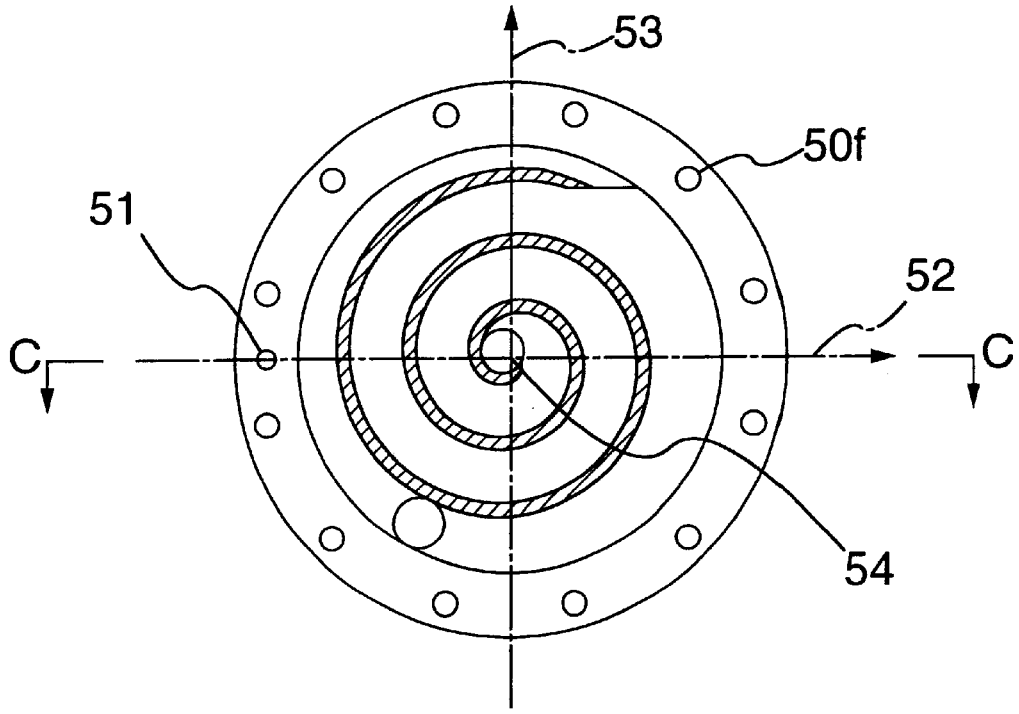
FIG. 6B is a plan view illustrating the stationary scroll shown in FIG. 6A.

Explanation will be made of the arrangement of a second embodiment of the present invention with reference to FIGS. 6A to 7B. Although the arrangement of the elongated positioning hole and the positioning pin is reversed in comparison with the configuration of the first embodiment, effects similar to those obtained by the configuration of the first embodiment can be obtained. FIGS. 6A and 6B show the arrangement of a stationary scroll 50. FIG. 6B is a plan view illustrating the stationary scroll 50 as viewed from the lap side, and FIG. 6A is a sectional view along line C—C in FIG. 6B, as viewed in the direction of arrows. The basic components of the stationary scroll 50 a lap 50*a,* a mirror plate 50*b,* a lap root 50*c,* a lap tip 50*d,* a discharge port 50*e,* fixing vacant holes 50*f* and a positioning pin 51. It is noted that the XY coordinates are defined by an X-axis 52 and Y-axis 53 and an original point which is the center 54 of the lap 50*a.* Although the positioning pin 51 may be located at any position on the stationary scroll, it is located on the X-axis 52 of the lap 50*a.* Referring to FIGS. 6A and 6B, the positioning pin 51 and the stationary scroll 50 are formed, independent from each other, but they can be integrally incorporated with each other.

Figure 7A:
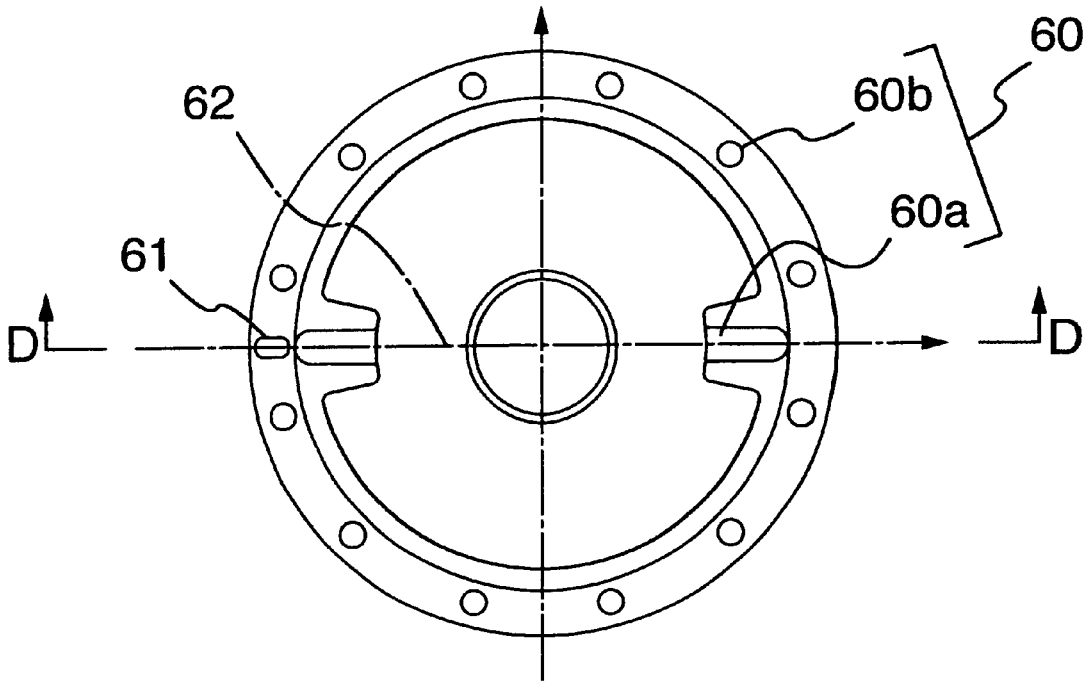
FIG. 7A is a plan view illustrating the arrangement of a frame in a second embodiment.
Figure 7B:
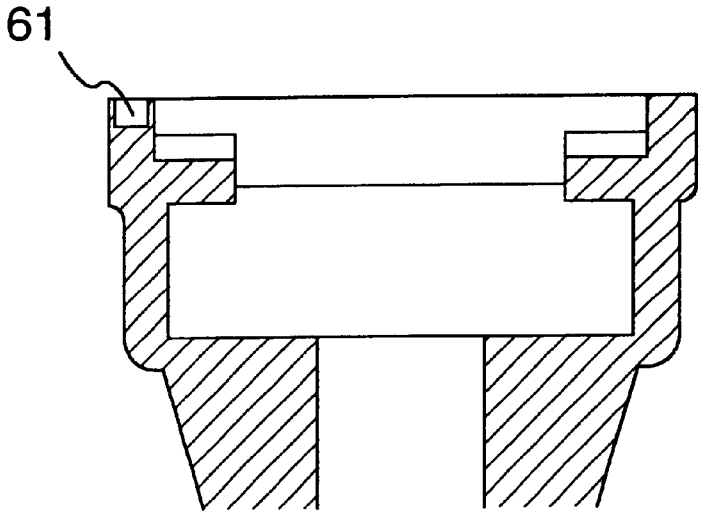
FIG. 7B is a sectional view illustrating the frame shown in FIG. 7A.

FIGS. 7A and 7B show the arrangements of the frame 60 which is an unorbiting scroll fixing member for fixing the stationary scroll 50. FIG. 7A is a plan view illustrating the frame 70 as viewed from the stationary scroll side, and FIG. 7B is a sectional view along line D—D in FIG. 7A, as viewed in the direction of arrows. The basic components of the frame 60 is key grooves 60*a* in each of which one of two key parts which are formed on an Oldham's ring serving a main component of a rotation preventing mechanism, orthogonal to each other, slides, fixing thread parts 60*b* corresponding to the vacant holes 50*f* in the stationary scroll, and an elongated positioning hole 61. It is noted here that since the positioning pin 51 is set on the X-axis 52 of the lap 50*a* in the configuration of the present embodiment, the parallel parts of the elongated hole 61 in the frame 60 may be formed so that they are substantially parallel with a straight line 62 on the frame 60 corresponding to the X-axis 52 of the lap 50*a,* and the straight line passes between the parallel parts of the elongated hole 61 in such a case that the stationary scroll 50 is arranged at the neutral position.

In the configuration of the present embodiment, although the parallel parts of the elongated positioning hole 61 are formed so as to be substantially parallel with the straight line 62 on the frame 60 corresponding to the X-axis 52, they may not always be parallel with the X-axis 52, but they may be formed, substantially parallel with a straight line on the frame 60 corresponding to a substantially straight line substantially passing through the center of the pin part of the positioning pin 51 and the center of the lap 50*a.* However, it is desirable to set the position and the direction of the elongated positioning hole 61 so as to locate the above-mentioned straight line between the parallel parts of the elongated positioning hole 61. Further, although the X-axis 52 of the stationary scroll lap 50*a* and the straight line passing through the center of the key groove 60*a* in the frame 60 are happenedly coincident with each other, they may not be coincident with each other.

Figure 8A:
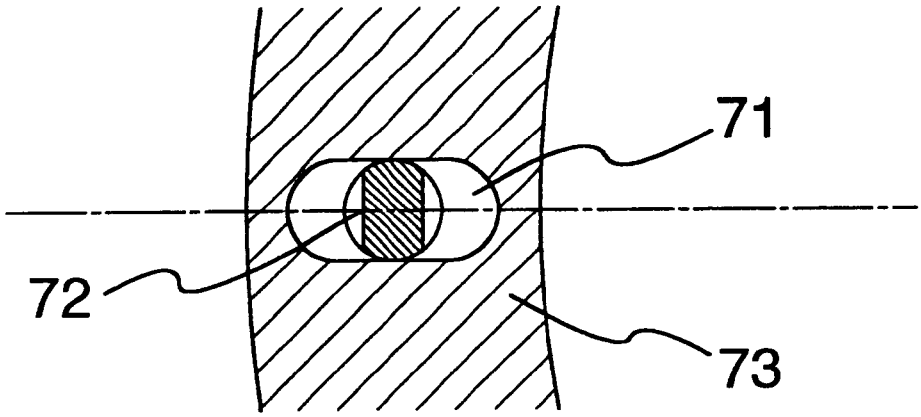
FIG. 8A is a plan view illustrating an example of a positioning pin in a third embodiment of the present invention.
Figure 8B:
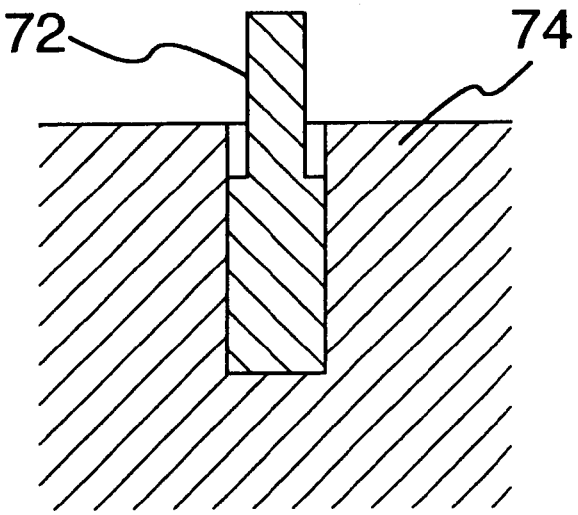
FIG. 8B is a sectional view illustrating the positioning means shown in FIG. 8A.

Explanation will be made of a third embodiment of the present invention with reference to FIGS. 8A and 8B. Referring to FIG. 8, there are shown a member 73 in which an elongated positioning hole 71 is formed, and a member 74 on which a positioning pin 72 is provided. FIGS. 8A is a sectional plan view which shows a fitting condition between the elongated positioning hole 71 and the positioning pin 72, and FIG. 8B is a sectional view which shows the shape of the positioning pin 72 and a condition in which the member provided thereon with the positioning pin 72 is arranged. In the configuration of the present embodiment, the shape of the positioning pin is different from those in the configurations of the first and second embodiments. The positioning pin 72 shown in FIG. 8, has a function such that it is movable in the elongated positioning hole 71 in the direction of the elongated hole but unmovable in the direction orthogonal to the direction of the elongated hole, but is rotatable around the axis of he positioning pin itself. Effects obtained by it as the positioning means are similar to those in the configuration of the first and second embodiments. The feature of the positioning pin 72 such that the part (pin part) to be fitted in the elongated positioning hole 71, has a pair of planar surfaces which are opposed to each other, and parts interposed between these planar surfaces exhibit cylindrical surfaces (substantially cylindrical in a section orthogonal to the axis of the pin part), the cylindrical surface parts have areas sufficient for rotation of the positioning pin 72.

It is noted here that only the cylindrical surface parts of the positioning pin 72 are those which make contact with the wall surfaces of the elongated positioning hole 71, and which should be processed with a high degree of accuracy. Thus, according to the configuration of the present embodiment, the process can be made by specifying the parts of the positioning pin which should be processed with a high degree of accuracy, and accordingly, it is possible to aim at shortening the processing time for the positioning pin 72. Further, since the positioning pin has the planar surface parts, different from a cylindrical positioning pin, the retentiveness of the positioning pin 72 becomes high when the positioning pin 72 is inserted in the member 74 in which it is to be set, and the positioning pin 72 can be surely inserted. Further, upon insertion, there is no such a risk that the cylindrical surface parts of the positioning pin 72 which make contact with the elongated positioning hole 72 are scratched. An insertion hole formed in the member 74 in which the positioning pin is arranged, and inserted therein with the hole part of the positioning pin 72, has a size with which the positioning pin 72 is not rotated within the insertion hole during assembly a compressor.

Figure 9A:
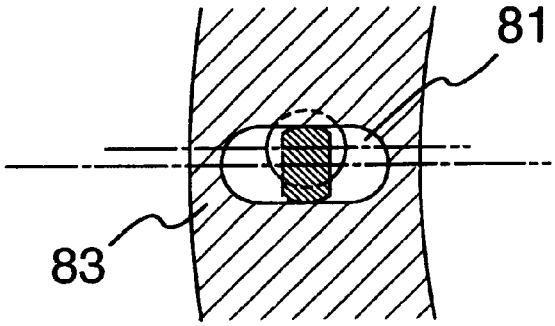
FIGS. 9A to 9C are plan view and sectional views, respectively, illustrating an example of the shape of a positioning pin in a fourth embodiment of the present invention.

Explanation will be made of the fourth embodiment of the present invention with reference to FIGS. 9A to 9C. Referring to FIGS. 9A and 9B, there are shown a member 83 in which an elongated positioning hole 81 is formed, and a member 84 on which a positioning pin 82 is arranged. In the configuration of the present embodiment, the shape of the positioning pin is different from those in the configurations of the first to third embodiments. FIG. 9A is a planar sectional view which shows a fitting condition between the elongated positioning hole 81 and the positioning pin 82, FIG. 9B is a sectional view which shows the shape of the positioning pin 82 and an arrangement condition of the member 84 in which the positioning pin 82 is arranged, and FIG. 9C is a sectional view along line D—D in FIG. 9B, as viewed in the direction of arrows.

Figure 9C:
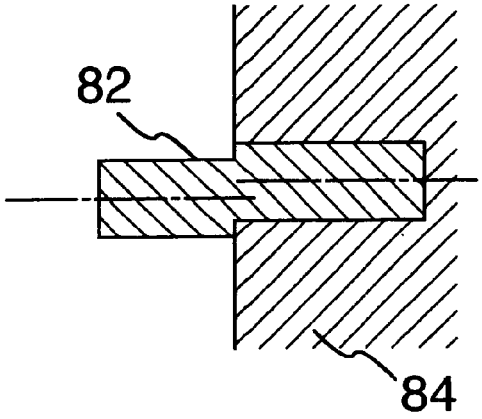
Figure 9B:
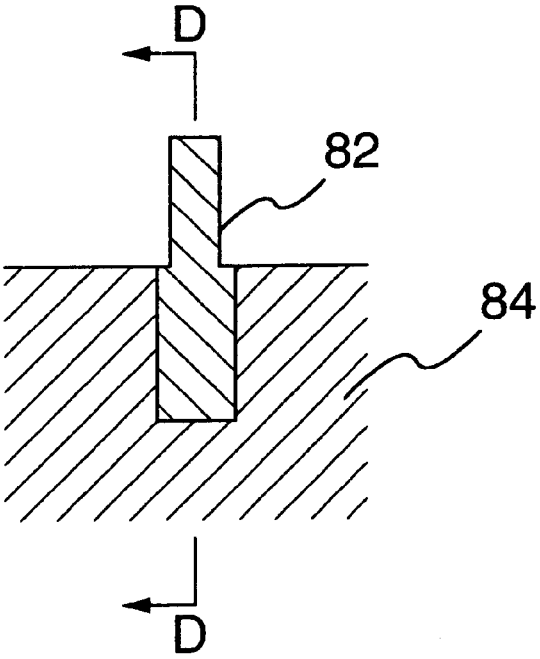
Figure 10:
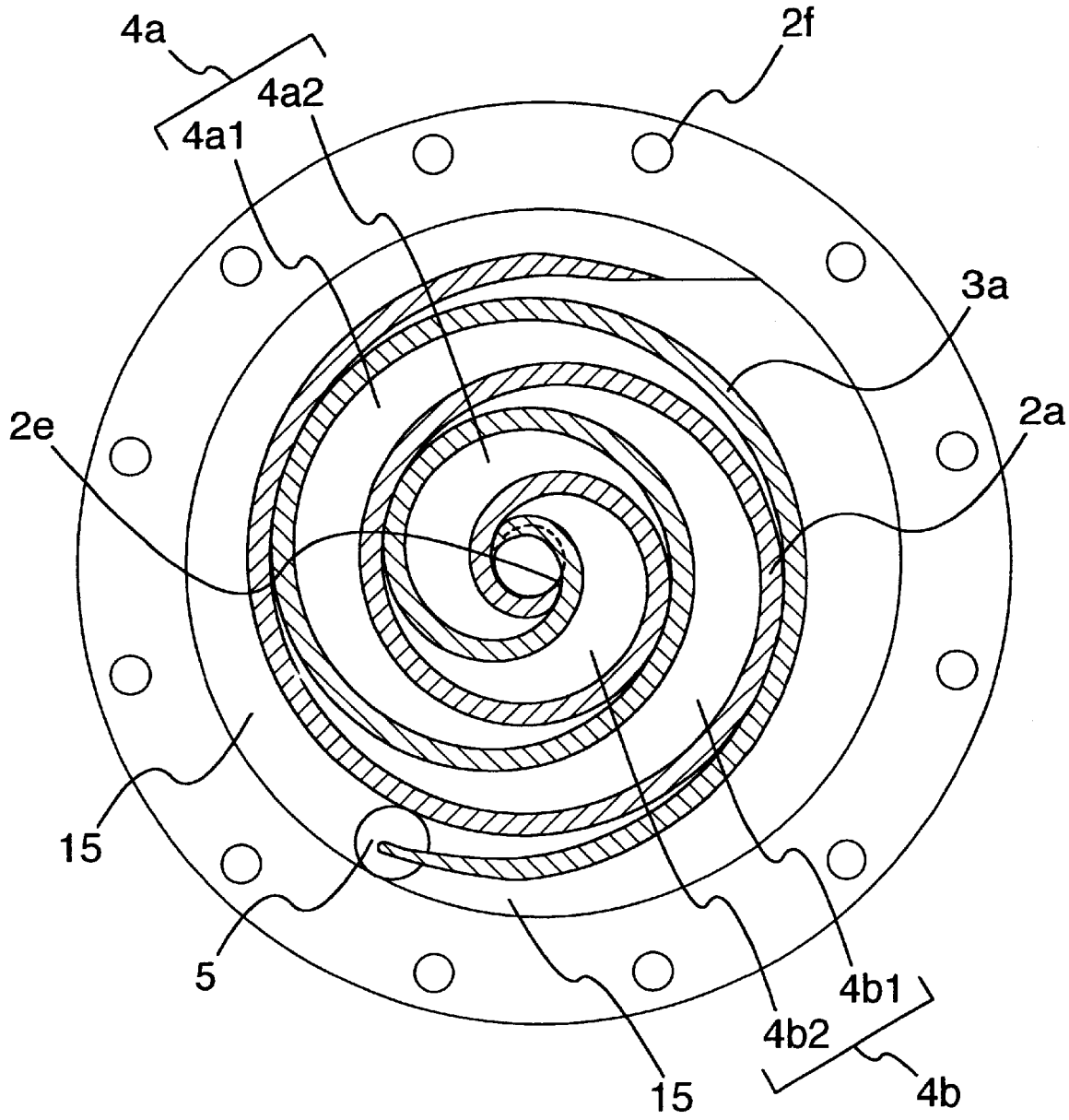
FIG. 10 is a plan view illustrating a plan view illustrating a compression chamber in a scroll compressor.
Figure 11:
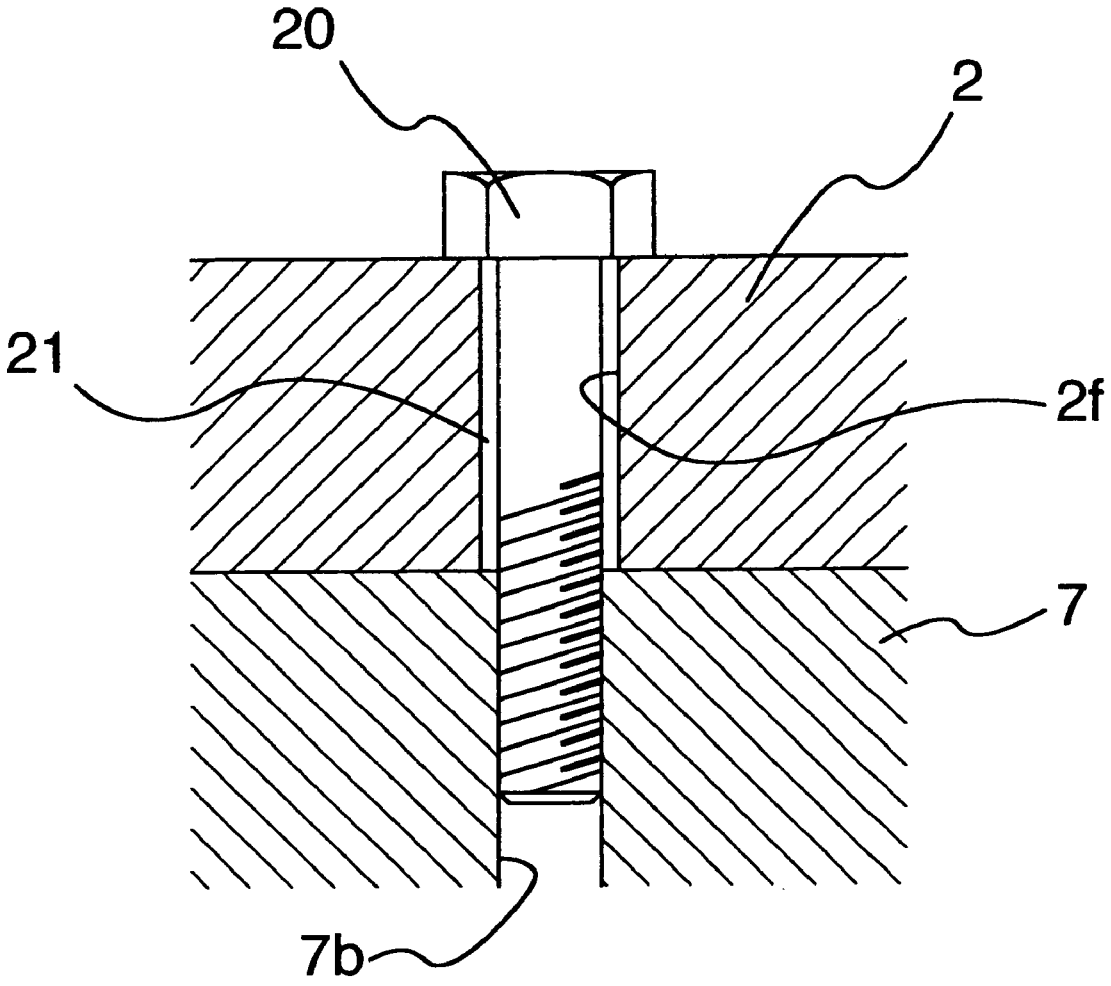
FIG. 11 is a sectional view showing an example of a method of fixing a stationary scroll and a frame in a conventional scroll type fluid machine.
Figure 12:
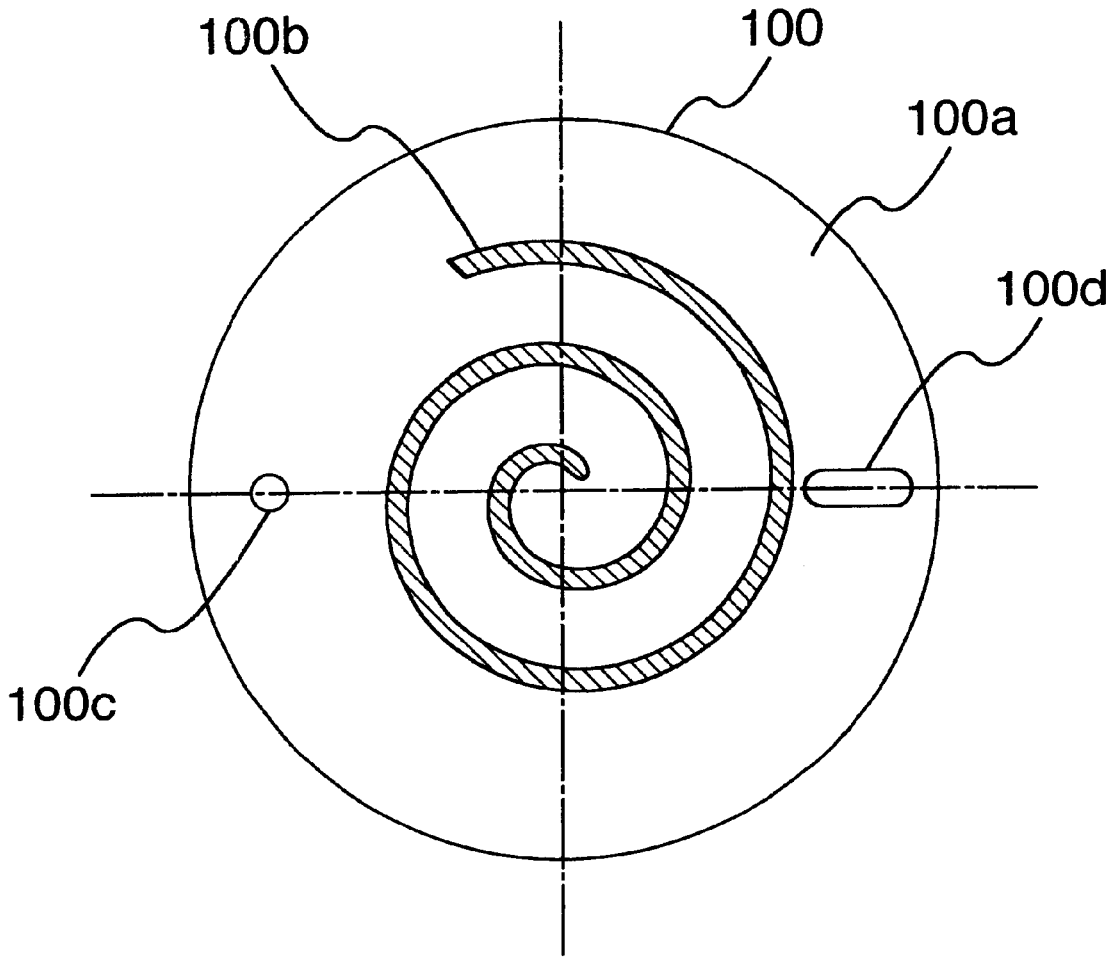
FIG. 12 is a plan view showing an example of a method of positioning a stationary scroll and a frame in a conventional scroll type fluid machine.

The positioning pin 82 shown in FIGS. 9A to 9C, has such a function that it is movable in the elongated positioning hole 81 in the direction of the elongated hole but unmovable in the direction orthogonal to the direction of the elongated hole but is rotatable. Effects obtained by it as the positioning means are similar to those in the configurations of the first to third embodiments. The feature of the positioning pin 82 is such that the center of a part (pin part) of the positioning pin 82 to be inserted in the elongated positioning hole 81, and the center of a hole part to be inserted in the member 84 on which the positioning pin 82 is set, are eccentric from each other. The eccentric direction is substantially orthogonal to the direction of the elongated hole 81. The shape of the pin part shown in FIGS. 9A to 9C, corresponds to that in the configuration of the third embodiment, that is, the part fitted in the elongated positioning hole 81 has such a shape that it has in part a cylindrical surface, but it may has a cylindrical shape. Further, different from the arrangement shown in FIG. 9, with such an arrangement that the diameter of the hole part is set to be larger than the diameter of a substantially cylindrical structure part of the pin part, the shape of the pin part may have such an arrangement that it is extended inward of the member 84 on which the pin is set. With the use of the positioning pin 82 which is eccentric in a direction substantially orthogonal to the direction of the elongated positioning hole 81, as the feature of the present invention, the degree of rotation and shift caused by unevenness in manufacturing accuracy of the stationary scroll lap and the orbiting scroll lap can be adjusted, thereby it is possible to always exhibit an appropriate meshing condition between both laps. In this case, an insertion hole for the positioning pin 82, formed in the member 84 has such a shape that the positioning pin 82 can not be simply rotated in the insertion hole during the assembly of compressor, and care should be taken in order to prevent the eccentric direction from being deviated upon insertion of the positioning pin 82.

In the configurations of the above-mentioned embodiments, explanation has been made of the scroll type fluid machine which is the combination of the stationary scroll fixed to the frame, and the orbiting scroll which is arranged so that its lap is meshed with the lap of the stationary scroll, not only a stationary scroll having such a structure that is literally fixed to the frame but also a stationary scroll having such a structure that allows displacement more or less in the axial direction of the drive shaft may be used. Even with such a stationary scroll, the position of the stationary scroll, relative to the frame in a plane orthogonal to the axis of the drive shaft, that is, the position relative to the orbiting scroll, should be set, similar to the configurations of the above-mentioned embodiments. If the stationary scroll which may be displaced more or less in the direction of the axis of the drive shaft, and the stationary scroll which is fixed to the frame by the fixing bolts 20 are both referred to an unorbiting scroll, the positioning pin and the elongated positioning hole can be applied in a scroll type fluid machine having an unorbiting scroll and an orbiting scroll.

ADVANTAGES OF THE INVENTION

According to the present invention, it is possible to provide a scroll type fluid machine which can practically exhibit an appropriate meshing condition between the orbiting scroll and the unorbiting scroll so as to ensure high energy efficiency.

What is claimed is:

1. A scroll type fluid machine comprising an unorbiting scroll member having a spiral scroll lap and performing limited motion in a plane orthogonal to the axis thereof; an orbiting scroll having a spiral scroll lap meshed with the scroll lap of the unorbiting scroll member so as to define compression chambers and performing orbiting motion without rotation around its axis in the plane orthogonal to the axis, an unorbiting scroll fixing member for unmovably fixing the unorbiting scroll member after the unorbiting scroll member and the unorbiting scroll fixing member are positioned in a positional relationship for assembly, and a positioning means for positioning relative positions of the unorbiting scroll member and the unorbiting scroll fixing member in the plane orthogonal to the axis for assembly before the unorbiting scroll member is fixed to the unorbiting scroll fixing member, characterized in that the positioning means comprises parts formed in both the unorbiting scroll fixing member and the unorbiting scroll member, and is adapted to mesh the unorbiting scroll member with the unorbiting scroll fixing member in the positional relationship for assembly, the positioning means permitting the unorbiting scroll member and the unorbiting scroll fixing member to have two motions relative to one another, one motion in a direction along a one straight line passing through a substantial center of the unorbiting scroll member in the plane orthogonal to the axis, and another motion rotatable about a straight line extending through a position on the one straight line around a peripheral edge of the unorbiting scroll member, in parallel with the axis.

2. A scroll type fluid machine as set forth in claim 1, characterized in that the positioning means is composed of an elongated hole structure having a major axis extended in the direction of the one straight line and a pair of wall surfaces which are opposed to each other, and which extend in parallel with the one straight line, and between which the one straight line extends, and a pin structure having a pin part rotatably fitted in the elongated hole so as to be movable along the pair of wall surfaces, either one of the elongated hole structure and the pin structure is formed in the peripheral edge part of the unorbiting scroll, and the other one of them is formed in the unorbiting scroll fixing member.

3. A scroll type fluid machine as set forth in claim 2, wherein the pin part of the pin structure is formed in a substantially circular shape in a section orthogonal to the axis of the pin part, and the center of the substantially circular shape is located on the one straight line.

4. A scroll type fluid machine as stated in claim 2 or 3 characterized in that the pin structure is composed of the pin part and a hole part for fixing the pin part, which are formed separate from each other.

5. A method of assembling a scroll type fluid machine as set forth in claim 1, characterized by the steps of positioning the unorbiting scroll member with respect to the unorbiting scroll fixing member with the use of the positioning means.

6. A method of assembling a scroll type fluid machine as set forth in claim 5, characterized in that the unorbiting scroll member is moved as far as possible in a direction toward the substantial center of the scroll lap of the unorbiting scroll member at an arbitrary turn angle, from the center of the scroll lap of the orbiting scroll member in such a condition that the pin structure is fitted in the elongated hole structure, and thereafter, when the unorbiting scroll member is moved as far as possible in a direction toward the substantial center of the scroll lap of the unorbiting scroll member, from the center of the scroll lap of the orbiting scroll member at an angle up to which it is turned by an angle of 180 deg. from the turn angle, and the unorbiting scroll member is positioned at a middle point between a position after the movement at the arbitrary turn angle and a position after the movement at the angle of turning of about 180 deg.

7. A method of assembling a scroll type fluid machine as set forth in claim 6, characterized in that the movement is carried out at least at a set of turn angles, and the unorbiting scroll member is positioned at the middle point of the movement.

* * * * *